US006012396A

United States Patent [19]

Schulz

[11] Patent Number: 6,012,396

[45] Date of Patent: Jan. 11, 2000

[54] ELECTRIC RAIL TRANSPORTATION SYSTEM, VEHICLE, AND RAIL USED IN THE TRANSPORTATION SYSTEM

[76] Inventor: Bruce DeLeon Schulz, 1325 N. Cascade Ave., Colorado Springs, Colo. 80903

[21] Appl. No.: 09/038,854

[22] Filed: Mar. 12, 1998

[51] Int. Cl.[7] ..... B61C 11/00

[52] U.S. Cl. ..... 105/72.2; 105/215.1; 105/215.2

[58] Field of Search ..... 104/242, 243, 104/244; 105/215.1, 215.2, 217, 72.2

[56] References Cited

U.S. PATENT DOCUMENTS

| | | | |
|---|---|---|---|
| 1,807,793 | 6/1931 | Moore . | |
| 1,886,573 | 11/1932 | Nelson . | |
| 1,908,437 | 5/1933 | Nelson . | |
| 1,926,695 | 9/1933 | Hutton | 105/215 |
| 2,002,901 | 5/1935 | Main | 105/215 |
| 2,018,972 | 10/1935 | Pollock et al. | 105/215 |
| 2,101,711 | 12/1937 | Hubbell | 105/215 |
| 2,162,351 | 6/1939 | Main | 105/215 |
| 2,226,287 | 12/1940 | Miller | 213/75 |
| 3,010,411 | 11/1961 | Peras | 105/215 |
| 3,225,704 | 12/1965 | Gilvar et al. | 104/121 |
| 3,434,432 | 3/1969 | Seifert | 105/215 |
| 3,450,271 | 6/1969 | Bissett | 213/75 |
| 3,648,621 | 3/1972 | Fleming | 105/157 |
| 3,831,847 | 8/1974 | Serritella | 239/1 |
| 3,945,326 | 3/1976 | Seifert | 105/215 |
| 5,048,704 | 9/1991 | Takahashi | 213/75 |
| 5,289,778 | 3/1994 | Romine | 104/130 |
| 5,370,430 | 12/1994 | Mozafari | 293/120 |

*Primary Examiner*—Mark T. Le
*Assistant Examiner*—Robert J. McCarry, Jr.
*Attorney, Agent, or Firm*—Finnegan, Henderson, Farabow, Garrett & Dunner, L.L.P.

[57] ABSTRACT

A transportation system includes a rail system and a vehicle capable of traveling on a road surface or the rail system. The vehicle includes two sets of wheels, one wheel for riding on the road surface, and another for riding on the rail. The rail is provided at an acute angle, and the wheels pivot, so that an outer flange on the rail lockingly engages an outer flange on the wheel, thereby preventing derailment. A controller automatically controls the vehicles on the rail. Magnetized bumpers on the vehicles enable the vehicles to travel on the rail in pods. Transition zones for easy entrance and exit to and from the rail system are provided at road overpasses.

39 Claims, 11 Drawing Sheets

ELECTRIC RAIL TRANSPORTATION SYSTEM, VEHICLE, AND RAIL USED IN THE TRANSPORTATION SYSTEM

BACKGROUND OF THE INVENTION

1. Field of the Invention

The invention relates to a transportation system, a vehicle used in the transportation system, and a rail system used in the transportation system. More particularly, the invention relates to a transportation system and an associated vehicle and rail system in which the vehicle is capable of traveling both on a road surface and on the rail system.

2. Description of the Related Art

Fuel-powered and electric vehicles capable of traveling on a road surface are known. Vehicles, such as trains or subways, which travel on rails, are also known. Attempts have also been made to provide vehicles which are capable of traveling both on road surfaces and on rails.

The latter class of vehicles is less common because related attempts to develop such systems have had only limited success. Such vehicles have experienced tremendous difficulties transiting from road travel to rail travel, and vice versa. Such vehicles also have had trouble with derailments. Such vehicles also have experienced difficulty with such problems as wind resistance, traffic control difficulties, and so on. These multiple difficulties have dissuaded communities from adopting combined road/rail transportation systems.

SUMMARY OF THE INVENTION

To alleviate one or more of the shortcomings present in the related art, and in accordance with the purposes of the invention as broadly described below, a transportation system is provided. The transportation system comprises a vehicle having a first wheel including a tire to engage a road surface, and a second metal wheel having an outer flange. The first and second wheels are mounted adjacent one another on a first shaft, with the second wheel fixed to rotate with the first shaft, and the first wheel mounted to rotate independently of the first shaft. A clutch is provided between the first and second wheels for selectively engaging and disengaging the first and second wheels, the first wheel rotating with the second wheel at times when the clutch is engaged. A second shaft having a distal end is pivotally connected to the first shaft at a pivot point, such that the first and second wheels on the first shaft are pivotable about the pivot point. The system further comprises a rail engaging the second wheel, such that the vehicle is capable of traveling either on the road surface or the rail. The rail includes an outer flange and is positioned at a selected acute angle with respect to a vertical line such that when the second wheel engages the rail, the first and second wheels pivot about the pivot point, and the outer flange of said rail lockingly engages the outer flange of the second wheel.

In another embodiment of the invention, a transportation system includes a rail and at least two vehicles capable of traveling on either the rail or on a road surface. Each vehicle comprises a vehicle body having a front end and a rear end; a set of first and second wheels rotatably mounted beneath the vehicle body, each first wheel including a tire for engaging the road surface and each second wheel including a flange for engaging the rail; a first bumper retractably mounted at the front end of the vehicle body, the first bumper being magnetized and defining a first arc having a first radius; and a second bumper retractably mounted at the rear end of the vehicle body, the second bumper being magnetized and defining a second arc having a second radius. The front bumper of one vehicle magnetically attracts a rear bumper of the other vehicle at times when the vehicles travel on the rail, with the first bumper having the first arc with the first radius of one vehicle adjacent the second bumper having the second arc with the second radius of the other vehicle.

The invention further comprises a rail system for transporting a vehicle, the rail system including a generally Y-shaped structure having a vertical base portion projecting above the ground and a pair of arms projecting to either side of the vertical base portion. A track projects from each end portion, each track being generally V-shaped, defined by a pair of rails, each rail being provided at a selected acute angle with respect to the vertical base portion, and having an outer flange for lockingly engaging a flanged wheel on the vehicle.

Preferably the rail system includes transition zones, i.e., entrance ramps and exit ramps, provided at existing road overpasses, where the vehicle transits onto and off of the rail system. An automated system performs a status check of the vehicle prior to transiting from the road to the rail system, to ensure the vehicle is suitable for rail travel. If the status check is unsatisfactory, the automated system instructs a switch system at the respective transition zone to not allow the vehicle to enter the rail system.

BRIEF DESCRIPTION OF THE DRAWINGS

The accompanying drawings, which are incorporated in and constitute a part of this specification, illustrate preferred embodiments of the invention. Together with the general description given above and the detailed description of the preferred embodiments below, the drawings help explain the principles of the invention.

DESCRIPTION OF THE PREFERRED EMBODIMENTS

Reference will now be made in detail to the presently preferred embodiments of the invention as broadly illustrated in the accompanying drawings.

Figure 1:
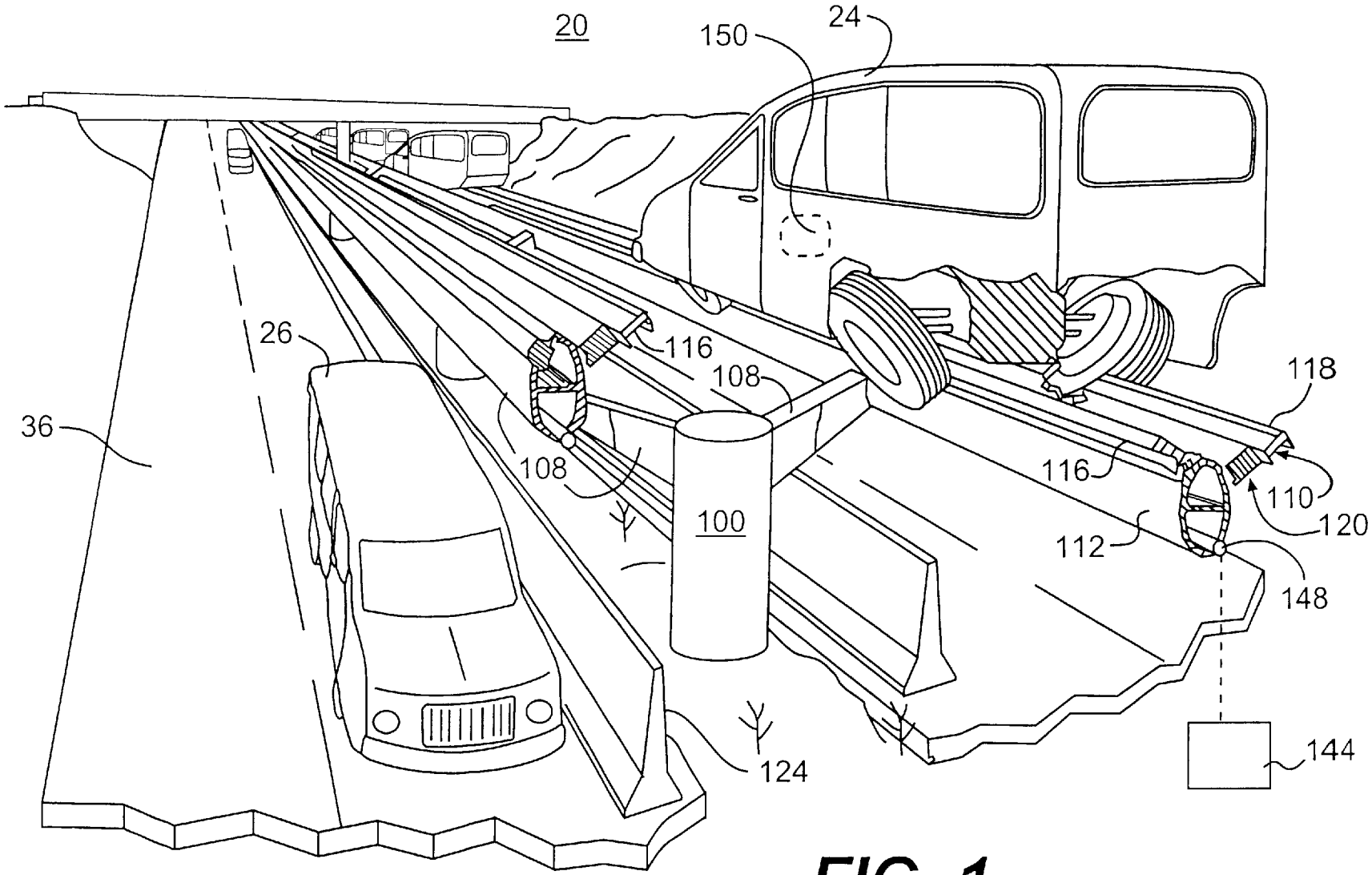
FIG. 1 is a perspective view of a transportation system in accordance with the invention, including vehicles traveling on a road surface and vehicles traveling on an elevated rail system adjacent the road surface, with the vehicles traveling on the rail system being capable of traveling either on the rail or on the road surface.
Figure 2:
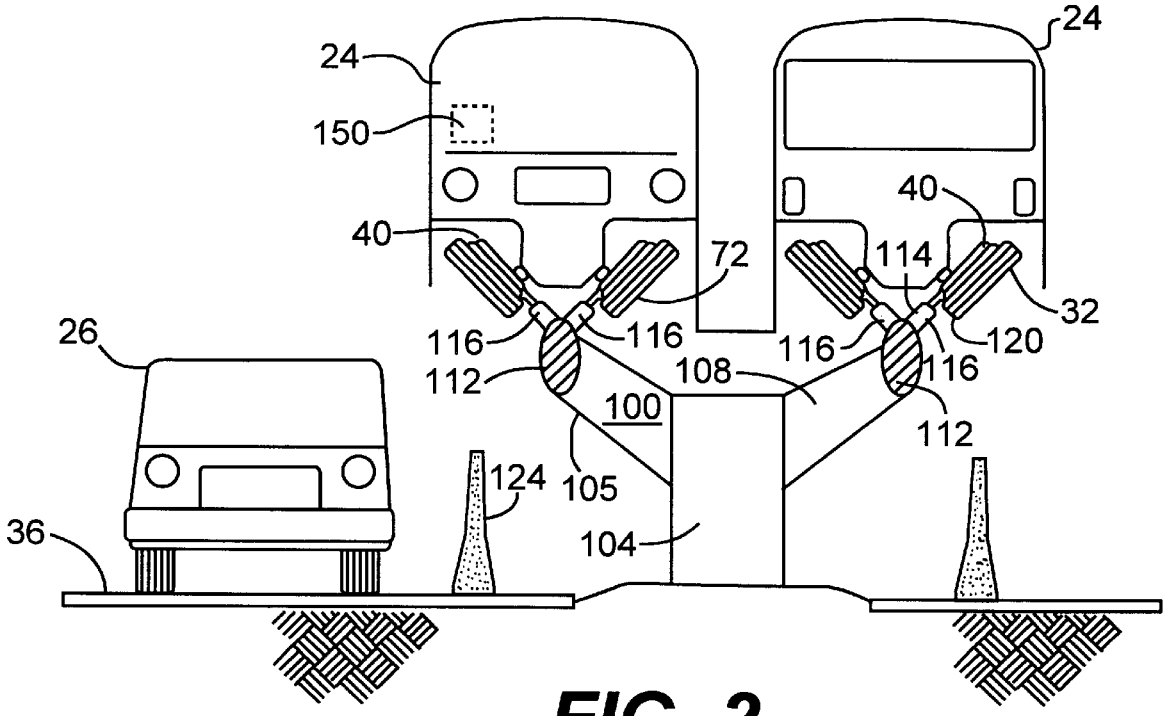
FIG. 2 is a front diagrammatic view of FIG. 1, depicting vehicles traveling on the rail in both directions and another vehicle on the road surface.

As illustrated in FIGS. 1 and 2, the present invention relates to a transportation system 20. The transportation system 20 includes a vehicle 24. FIGS. 1 and 2 depict a vehicle 24 in accordance with the invention, traveling on a rail, adjacent a road on which conventional road vehicles 26 are traveling. Vehicle 24 is preferably about 7.0' in height. The configuration and operation of vehicle 24 will be fairly conventional, except as described below.

Figure 3A:
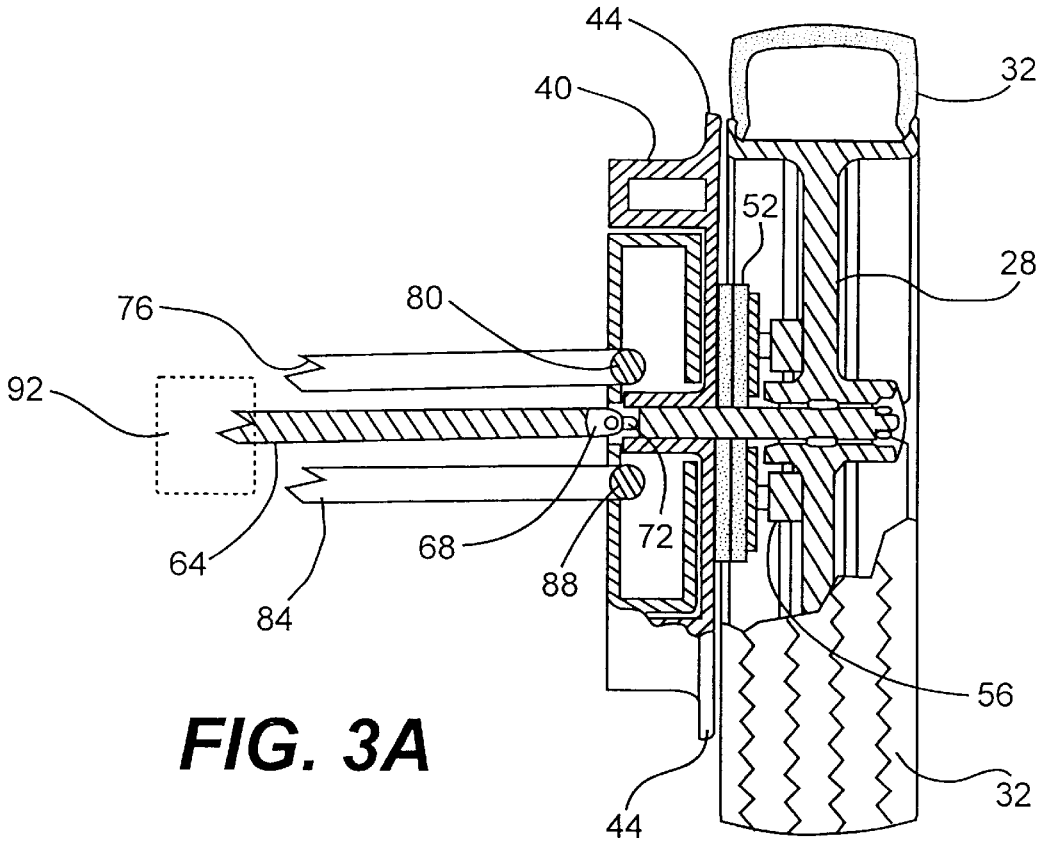
FIG. 3A is a partially cutaway front view of the first and second wheels and clutch arrangement for a vehicle capable of traveling either on the rail or the road surface in accordance with the invention, with the clutch engaged.
Figure 4A:
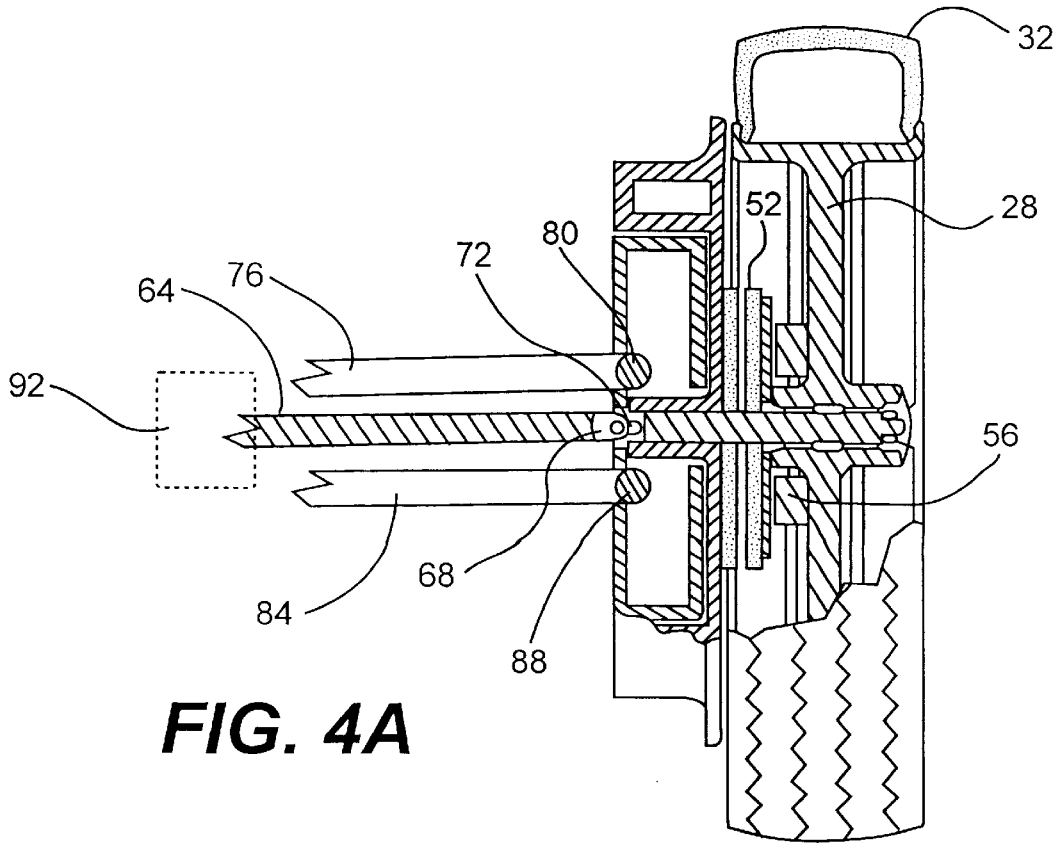
FIG. 4A is a partially cutaway front view of the same dual wheel and clutch arrangement depicted in FIG. 3A, with the clutch disengaged and the second wheel engaging the rail.

In accordance with the invention, the vehicle comprises a first wheel including a tire to engage a road surface, and a second metal wheel having an outer flange, the first and second wheels being mounted adjacent to one another on a first shaft, with the second wheel fixed to rotate with the first shaft and the first wheel mounted to rotate independently of the first shaft. As shown in FIGS. 2, 3A and 4A, a first wheel 28 having a tire 32 (wheel and tire shown partially in cross section in FIGS. 3A and 4A) mounted thereon is provided so the vehicle 24 can travel on the surface of a road 36. Preferably, tire 32 has a 30" diameter.

A second metal wheel 40 (also shown partially in cross section in FIGS. 3A and 4A), preferably made of steel, is mounted adjacent to and preferably inboard of first wheel 28. (For purposes of description, and referring to FIGS. 3A and 4A, the inboard or inner side of the wheels is toward the vehicle or to the left in FIGS. 3A and 4A, and the outboard or outer side of the wheels is away from the vehicle or to the right in FIGS. 3A and 4A). Preferably, second wheel 40 has a 22" diameter. Second wheel 40 is configured with an outer flange 44 on the outer side of the wheel 40. The purpose of outer flange 44 will be discussed below.

Both first wheel 28 and second wheel 40 are mounted on a first shaft 48. Metal second wheel 40 is fixed to the first shaft 48, and consequently always rotates with the first shaft 48. First wheel 28, however, is not fixed to first shaft 48, but instead is mounted to be rotatable relative to first shaft 48, and can rotate independently of first shaft 48. Rotation of first wheel 28 is described below.

In accordance with the invention, the vehicle further comprises a clutch between the first and second wheels, for selectively engaging and disengaging the first and second wheels, the first wheel rotating with the second wheel at times when the clutch is engaged. As shown in FIGS. 3A and 4A, a clutch 52 is provided intermediate first wheel 28 and second wheel 40. Clutch 52 is shown in the engaged position in FIG. 3A, and in the disengaged position in FIG. 4A. When clutch 52 is engaged, as in FIG. 3A, first wheel 28 is directly coupled to second wheel 40. Consequently, rotation of first shaft 48 and second wheel 40 will drive first wheel 28, causing first wheel 28 to rotate. When clutch 52 is disengaged, as in FIG. 4A, first wheel 28 can rotate independently.

It is preferred that an electric solenoid be provided to operate the clutch. Referring to FIGS. 3A and 4A, a solenoid 56 is mounted to the rim of first wheel 28, including a retractable pin 60 for moving the clutch pieces in and out of engagement. Solenoid 56 can be either manually or automatically operated to engage or disengage the pieces of clutch 52.

In accordance with the invention, the vehicle further comprises a second shaft having a distal end pivotally connected to the first shaft at a pivot point, such that the first and second wheels on the first shaft are pivotable about the pivot point. As shown in FIGS. 3A and 4A, a second shaft 64 has a distal end 68 linked to an end of first shaft 48 at a pivotal U-shaped linkage defining a pivot point 72. First shaft 48 can pivot about pivot point 72 with respect to second shaft 64. As first shaft 48 pivots, first and second wheels 28 and 40 also pivot about pivot point 72.

It is preferred that an elongated support rod be linked to the second wheel, the support rod being movable back and forth in a direction generally parallel to the second shaft, thereby pivoting the first and second wheels about the pivot point. Referring to FIGS. 3A and 4A, a support rod 76 is provided parallel to second shaft 64, linked to second wheel 40 at a pivotal linkage 80. Support rod 76 is movable in the inner and outer directions. As support rod 76 moves inward or outward, the motion is translated via pivotal linkage 80 such that second wheel 40, first wheel 28, and first shaft 48 are forced to pivot about pivot point 72. It is further preferred that a second support rod 84 be provided on the opposite side of second shaft 64, connecting to second wheel 40 at a second pivotal linkage 88. The two support rods 76 and 84 can work together to pivot the wheels about pivot point 72, either by one support rod moving outward while the other moves inward, by both support rods moving inward a different amount, or by one support rod remaining fixed while the other support rod moves.

Propulsive force for first wheel 28, while the vehicle 24 is traveling on road surface 36, can be provided in a variety of ways. For example, second shaft 64 can be linked to a driving force 92 such as a vehicle engine. Driving force 92 can be, for example, a conventional gasoline engine, a diesel engine, or an electric motor.

Figure 8A:
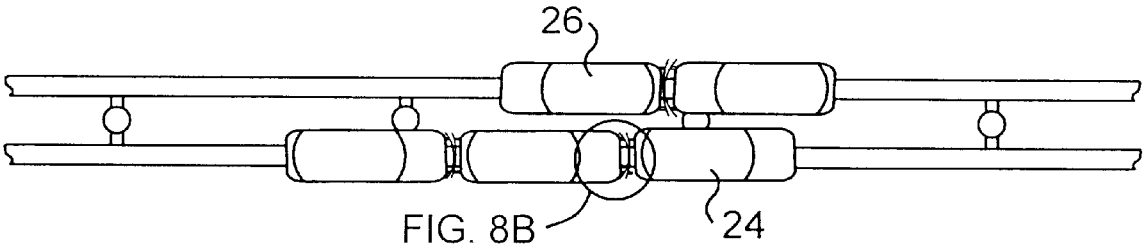
FIG. 8A is a top view of several vehicles traveling on a rail in accordance with the invention, engaged together in a pod.
Figure 8B:
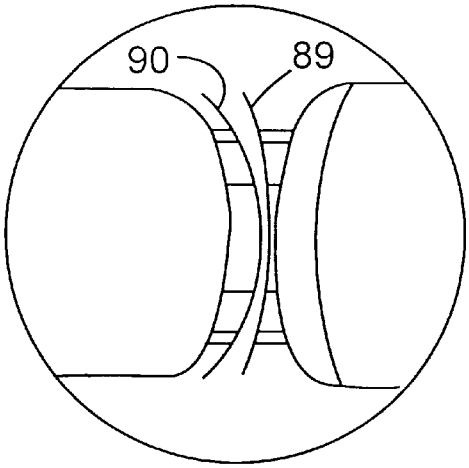
FIG. 8B is an enlarged top view depicting engagement of front and rear retractable magnetized bumpers of two adjacent vehicles in FIG. 8A.
Figure 9:
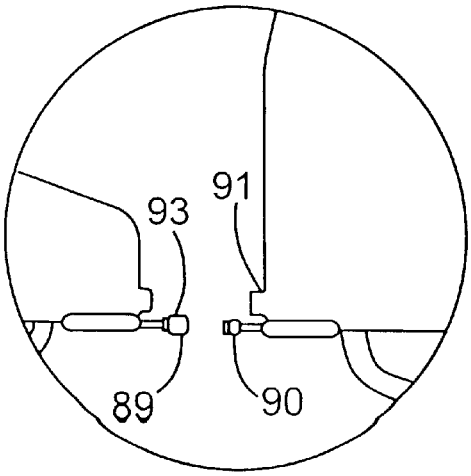
FIG. 9 is a side view of the retractable magnetized bumpers depicted in FIG. 8B.
Figure 10:
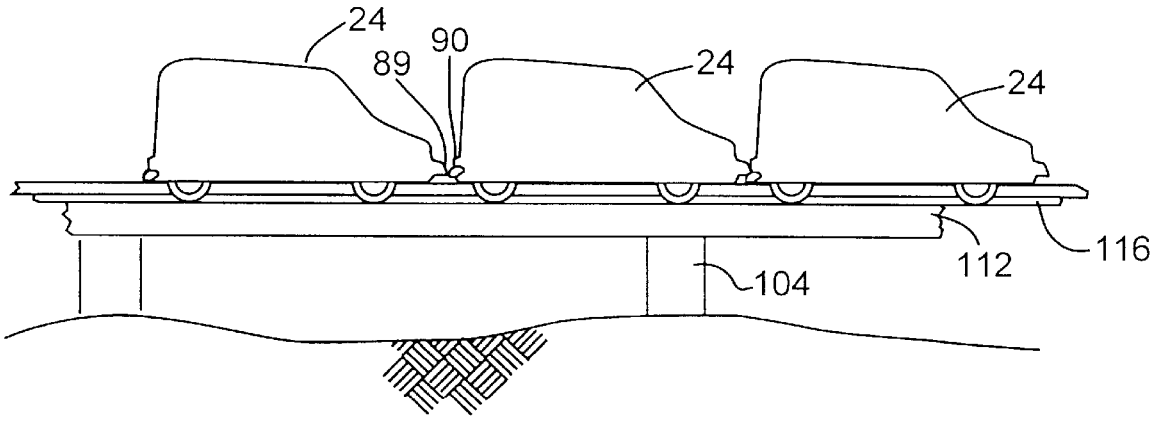
FIG. 10 is a side view of several vehicles engaged together on the rail in a pod as in FIG. 8A.

In accordance with the invention, the vehicle further includes a magnetized front bumper retractably mounted at a front end of the vehicle, and a magnetized rear bumper retractably mounted at a rear end of the vehicle. Referring to FIGS. 8A, 8B and 9, each vehicle 24 is configured with a front bumper 89 and a rear bumper 90. Each bumper 89 and 90 is magnetized, each respective front bumper and rear bumper having a reversed polarity, and configured to retract into or under the body of vehicle 24. The bumpers 89 and 90 can also be spring-loaded to absorb impact. The magnetized retractable bumpers 89 and 90 are preferably located just below a pair of conventional front and rear bumpers 91 and 93, respectively. The conventional bumpers 91 and 93 are used when the vehicle 24 travels on a road surface, at which time the magnetized bumpers 89 and 90 preferably are fully retracted. Magnetized bumpers 89 and 90 preferably are extended for use only when vehicle 24 travels on the rail system.

The bumpers preferably are configured as shown in FIG. 8B. Each bumper preferably is arcuate in shape, defining an arc having a selected radius. It is preferred that the two arcs of the two bumpers have different radii. It is further preferred that the radius of the arc of front bumper 89 be smaller than the radius of the arc of rear bumper 90, as shown in FIG. 8B. It is also preferred that the direction of the arc of the front bumper 89 be away from the front end of vehicle 24, whereas the direction of the arc of the rear bumper 90 be toward the rear end of the vehicle 24, as shown in FIG. 8B. However, it is also possible to reverse the orientation of the bumpers, and to make the front bumper have a larger radius than the rear bumper.

The bumpers 89 and 90 preferably will have the above-described configuration to assist several of the vehicles 24 to travel in pods. Referring to FIG. 8A, it will be seen that a plurality of vehicles 24 traveling on a rail can travel together in pods, with the magnetized bumpers engaged with one another. Formation of the vehicles 24 into pods reduces air resistance on individual vehicles, and increases safety and efficiency of the overall transportation system. The magnetized bumpers 89 and 90 will hold the vehicles together. The radius of one arc of one bumper is greater than the radius of the arc of an adjacent bumper, as shown in FIG. 8B, to assist the pods in traversing a turn or curve in the track, without breaking contact between adjacent bumpers. It is preferred that the pods be able to travel at speeds up to approximately 200 km/hr without difficulty.

In accordance with the invention, the transportation system further includes a rail for engaging the second wheel of the vehicle, such that the vehicle is capable of traveling either on the road surface or the rail. The rail includes an outer flange and is positioned at a selected acute angle with respect to a vertical line, such that when the second wheel engages the rail, the first and second wheels pivot about the rail, and the rail lockingly engages the outer flange of the second wheel. A rail system 100 in accordance with the invention is shown in FIGS. 1 and 2.

Preferably, rail system 100 includes a vertical support structure 104, also called a stantion or a pier, defining a vertical line. Vertical support structure 104 includes a pair of arm portions 108 projecting therefrom, defining a generally Y-shaped structure projecting above the ground. The distal end of each arm portion 108 comprises a generally oval-shaped tubular base 112, from each of which projects a track defined by a pair of rails 116, spreading outward to form a V-shape. Each rail 116, furthermore, includes a lower beam portion 118 and an upper rail portion 120.

In the preferred embodiment, shown in FIGS. 1 and 2, each rail system 100 is provided adjacent existing roads 36, and preferably in an existing median strip. The vertical support structure 104 is preferably approximately 2.0' in diameter. The tubular base 112 of the track is preferably approximately 6.0' above the ground, and the rails 116 are preferably approximately 7.0' above the ground. It is further preferred that a jersey barrier 124, preferably at least approximately 4.0' high, be provided between road surface 36 and rail system 100 to prevent unwarranted vehicle access and accidents.

The V-shape of rail 116 provides several advantages. All forces can be supported by tubular base 112, without requiring rail ties or dual support beams, as used in conventional rails. Also, the rails 116 can be supported on stantion 104, enabling the entire rail system to be provided between the lanes of a highway.

Figure 6:
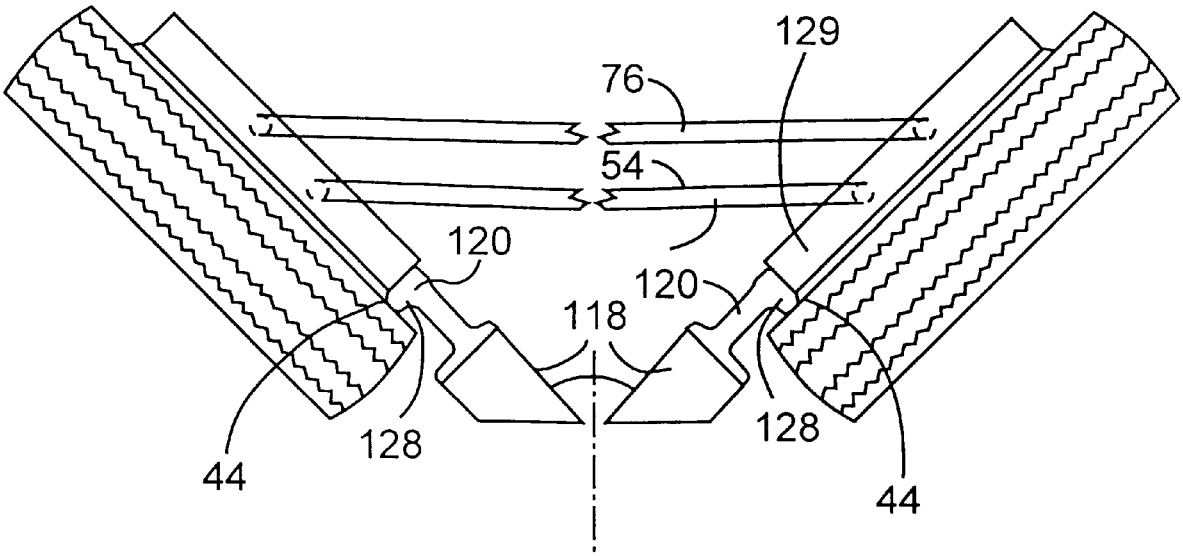
FIG. 6 is a front diagrammatic view of the dual wheel assembly in accordance with the invention, depicting two second wheels engaging the rails with the rails at the selected acute angle and the wheels pivoted about the pivot point.

As shown in FIG. 6, each rail 116 is angled at an acute angle θ with respect to a vertical line, i.e., a line parallel to the line defined by vertical support structure 104, such as a vertical line through tubular base 112. This acute angle θ of each rail 116 causes the V-shape of the track as shown in FIGS. 1, 2 and 6. Preferably, the acute angle θ is approximately 45°. The angle of rails 116 allows water to run off the rails easily, avoiding hydrostatic planing of the vehicle 24 when traveling on the rails 116. The V-shape of the rails also allows deletion of traditional railroad ties between the rails, hence reducing air flow impedance as the vehicles 24 transit on the rails 116.

Furthermore, the upper rail portion 120 of each rail 116 is configured with a flange 128. As can best be seen in FIGS. 4, 5 and 6, flange 128 is provided on the outboard side of rail 116. Flange 128 is provided on the outboard side so that as first wheel 28 and second wheel 40 pivot about pivot point 72, outer flange 128 of each rail 116 will slidingly yet lockingly engage outer flange 44 on each second wheel 40. As can be seen in FIGS. 4 and 6, engagement of outer rail flange 128 and outer wheel flange 44 prevents second wheel 40 from moving vertically upwards. Engagement of these flanges hence helps prevent vehicle 24 from derailing. This anti-derailing feature requires the flange 128 to be provided at the outer edge of rail 116, rather than the inner edge as on conventional rails, because the rails 116 are positioned at the acute angle θ with respect to the vertical, as described above.

In addition, rail 116 has a mating surface 129 that engages second wheel 40. Mating surface 129 extends to flange 128. The mating surface 129 preferably has a 90° angle with respect to rail 116, as shown in FIG. 6.

Figure 3B:
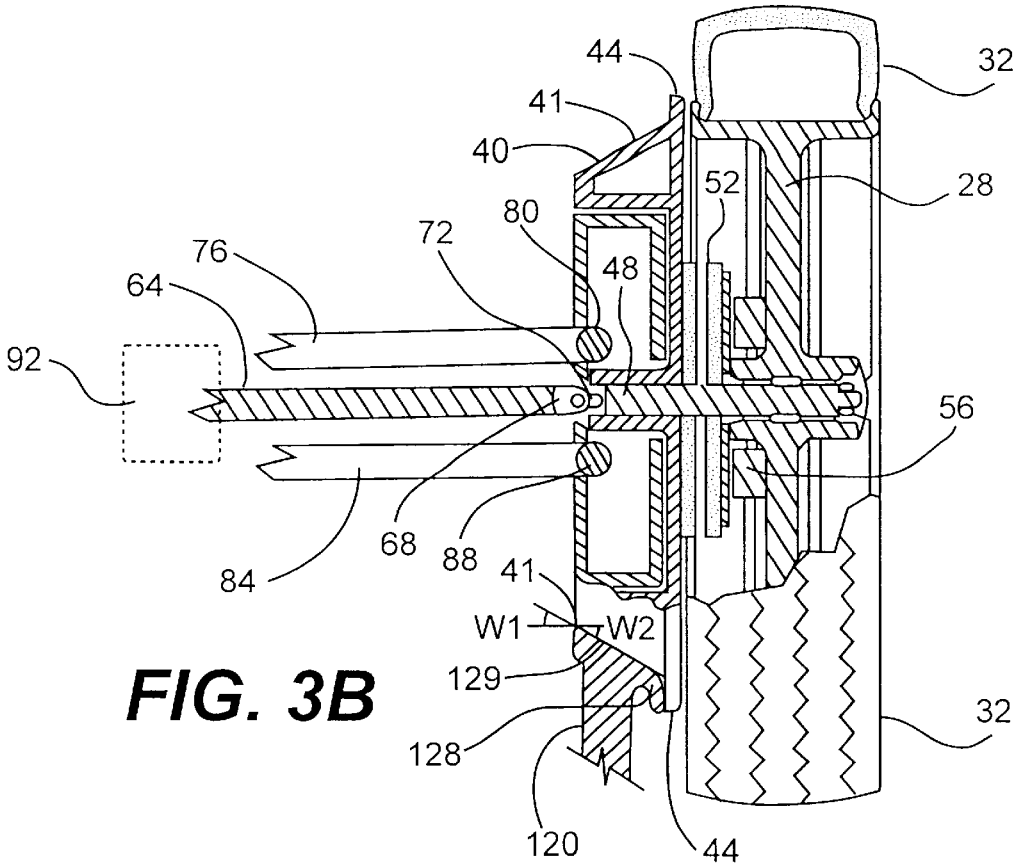
FIG. 3B is a view similar to FIG. 3A of an optional arrangement, with the clutch disengaged.
Figure 4B:
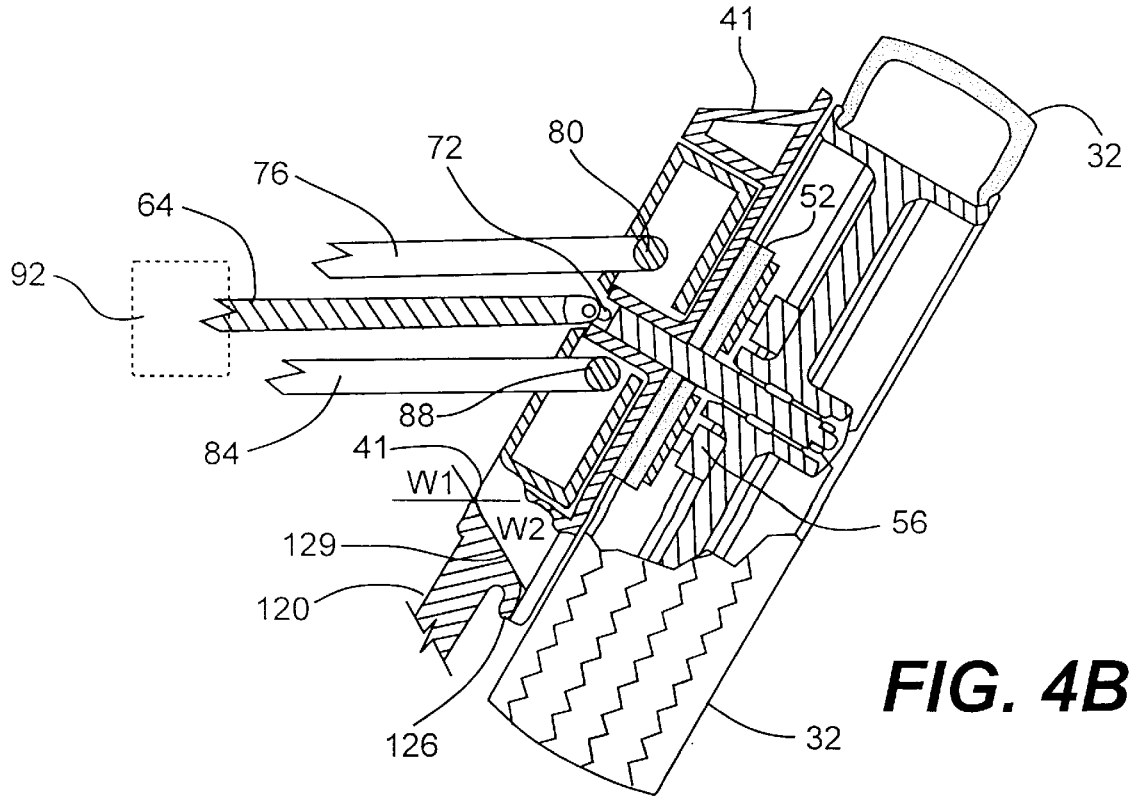
FIG. 4B is a view similar to FIG. 4A of an optional arrangement, with the clutch engaged.
Figure 5:
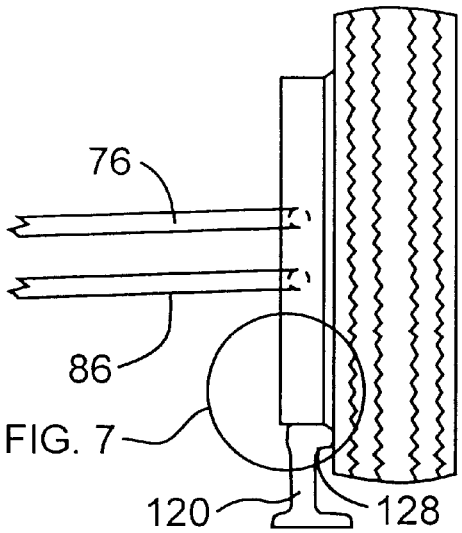
FIG. 5 is a front diagrammatic view of the dual wheel assembly with the second wheel riding on the rail.

It is optional, however, that mating surface 129 define a more acute angle $\omega_1$ with respect to the rail 116, as shown in FIGS. 3B and 4B. When the mating surface 129 of rail 116 has the acute angle $\omega_1$, steel second wheel 40 will be provided with a corresponding engaging surface 41 that is angled at acute angle C02 to engage with rail mating surface 129. In this option, both $\omega_1$ and $\omega_2$ will be 22.5°, in order to complement one another. This configuration creates the lock-on anti-derailing feature discussed above. Theoretically, this option increases traction between the wheel and the rail because of an increase in force between them, stabilizes the wheel system because of the outward force imparted by the slope on the wheels, and increases the ability of the rail to shed rain and snow.

Figure 7:
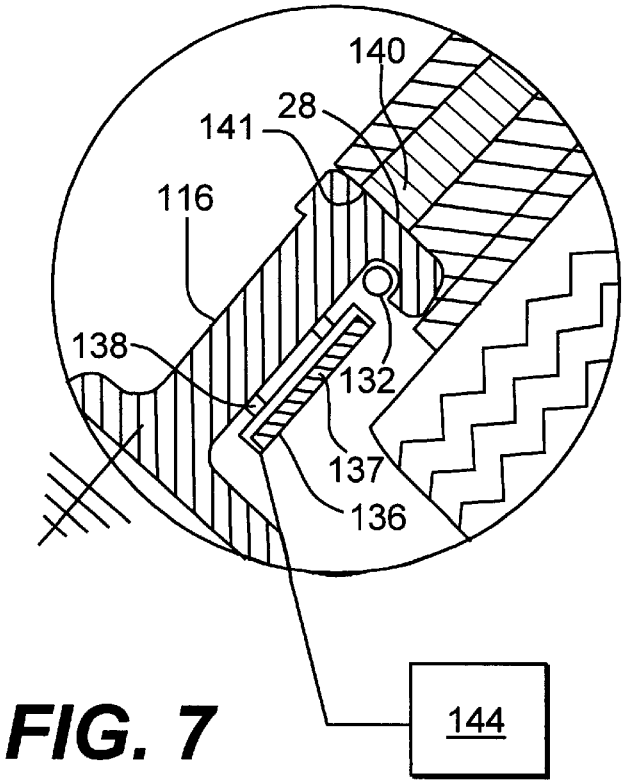
FIG. 7. is a detailed partial view depicting engagement between the second wheel and the rail and supply of electrical power to the vehicle.

It is further preferred that a means be provided to heat the rail, in order to efficiently remove snow and ice. FIG. 7 depicts one rail 116 and an outer flange 128 in cross section. A heated wire 132, which can be thermostatically and hydrostatically controlled, is provided beneath flange 128 to heat the rail 116. Heated wire 132 preferably is located in tubular base 112. Heated wire 132 preferably is turned on automatically when moisture is present and air temperature falls below the freezing point of water at atmospheric pressure.

It is further preferred that a source of power be provided to provide propulsive power to the vehicle via the rail and the second wheel, at times when the vehicle is traveling on the rail. Referring to FIG. 7, electric power from a power source (not shown) is provided through the rail 116 via a conductor 136, preferably a series of 5.0' copper strips laid end to end. The electrical circuit senses the power demand of vehicle 24 as it is travelling in the rail, and sequentially energizes and deenergizes the respective 5.0' strips of conductor 136. As vehicle 24 is on one strip, the next sequential strip is energized, and the strip from which the vehicle just departed is deenergized. Conductor 136 can be either fixed to the rail 116, as shown in FIG. 7, or embedded in the top surface of rail 116. These copper strip conductors 136 effectively divide the rail 116 into separate rail segments. Conductors 136 are preferably fixed to rail 116 via a rubberized insulator 137 and a stand-off insulator 138. Also, the rail 116 should be electrically grounded, as shown in FIG. 7.

Furthermore, a conductor 140, preferably a series of short copper strips overlapping one another, is arranged around the circumference of second wheel 40. It is preferred that some type of spongy material be provided between conductor 140 and the steel surface of second wheel 40 in order to make the diameter of the conductor 140 slightly larger than the diameter of steel wheel 40. The increase in diameter should only be enough to ensure continuous contact between conductors 136 and 140. However, there should be no weight of second wheel 40 bearing on conductor 140. The weight of second wheel 40 is borne instead on an elastic pad 141, shown in FIG. 8, which is preferably a rubber pad. Elastic pad 141 reduces the noise of the steel wheel 40 traveling on the rail system.

It is preferred that the electrical power supply through the rail be controlled by a controller. Referring to FIGS. 1 and 7, a controller 144 is provided with the system to selectively control application of electrical power to conductor 136. Controller 144, which is positioned at a remote location, allows automatic control of the entire transportation system 20.

For example, once vehicle 24 enters the rail portion of the system, the controller 144 controls the speed of vehicle 24 by informing the vehicle 24 of the speed at which it should be travelling. Alternatively, the controller 144 can secure power to an individual vehicle 24 by shutting off electrical power to an individual 5.0' rail segment 116. Hence, the controller 144 can be used to avoid accidents on the system by stopping vehicles 24 at selected locations on the rail before accidents occur.

Automatic control of the transportation system 20 provides additional advantages as well. Controller 144 always knows the location of each vehicle 24 on the rail system. The controller 144 can communicate with the entire system via cables 148, preferably fibre optic cables provided in tubular base 112. Furthermore, a second controller 150, which can be a stand alone computer or a slave to controller 144, can be provided in each vehicle 24. This allows communication between each vehicle 24 and the main controller 144.

For example, before a vehicle 24 enters the rail system, controller 150 can perform a status check on vehicle 24, e.g., checking that doors are closed, that no items are piled on the roof that would be too high to clear overheads on the rail system, and so on. If the status check is unsatisfactory, main controller 144 can prevent vehicle 24 from entering the rail system, e.g., by securing power to the segments of rail 116 at the respective entrance ramp, or by not allowing the switch (described below) to move into the proper position to permit access to the rail. A status check can also be performed before the vehicle exits the rail system. If a vehicle 24 is not ready to exit the rail (e.g., because the driver is not prepared, or the vehicle fails the status check), controller 144 can prevent exit at a respective exit ramp by not allowing the respective switch to move to the exit position.

Automobile controller 150 can also send an exit signal to solenoid 56 to disengage clutch 52. Operation of heated wire 132 and similar control functions will be performed by controller 144.

Controller 144 can also control formation of several vehicles 24 into pods as shown in FIGS. 8A and 8B. Controller 144 can instruct each vehicle to extend its retractable magnetized bumpers 89 and 90, and can adjust the speed of each vehicle 24 to allow contact without excessive shock. When a new vehicle enters the rail system, the controller 144 can either break apart an existing pod to allow a gap for the new vehicle 24, e.g., by de-energizing two respective magnetized bumpers 89 and 90 to create a gap, then re-energizing the bumpers when the new vehicle 24 enters the pod. The controller 144 can also break up a pod when one vehicle 24 signals its intent to exit the rail system.

In accordance with the invention, transfer zones are provided in the rail system for transiting the vehicle back and forth from travel on the rail to travel on the road surface. Referring to FIGS. 11A, 11B, 11C, 11D, 12A, and 12B, transition zones include entrance ramps 151 and exit ramps 172. In order to maximize efficient use of the existing road infrastructure, it is preferred that entrance ramps 151 and exit ramps 172 be provided at existing overpasses, where the road 36 bridges over the rail system 100.

Figure 11D:
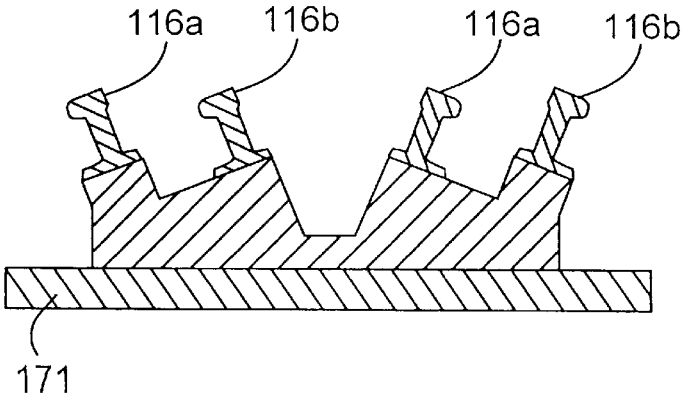
FIG. 11D is a cross sectional view of the switch shown in FIG. 11C.
Figure 11A:
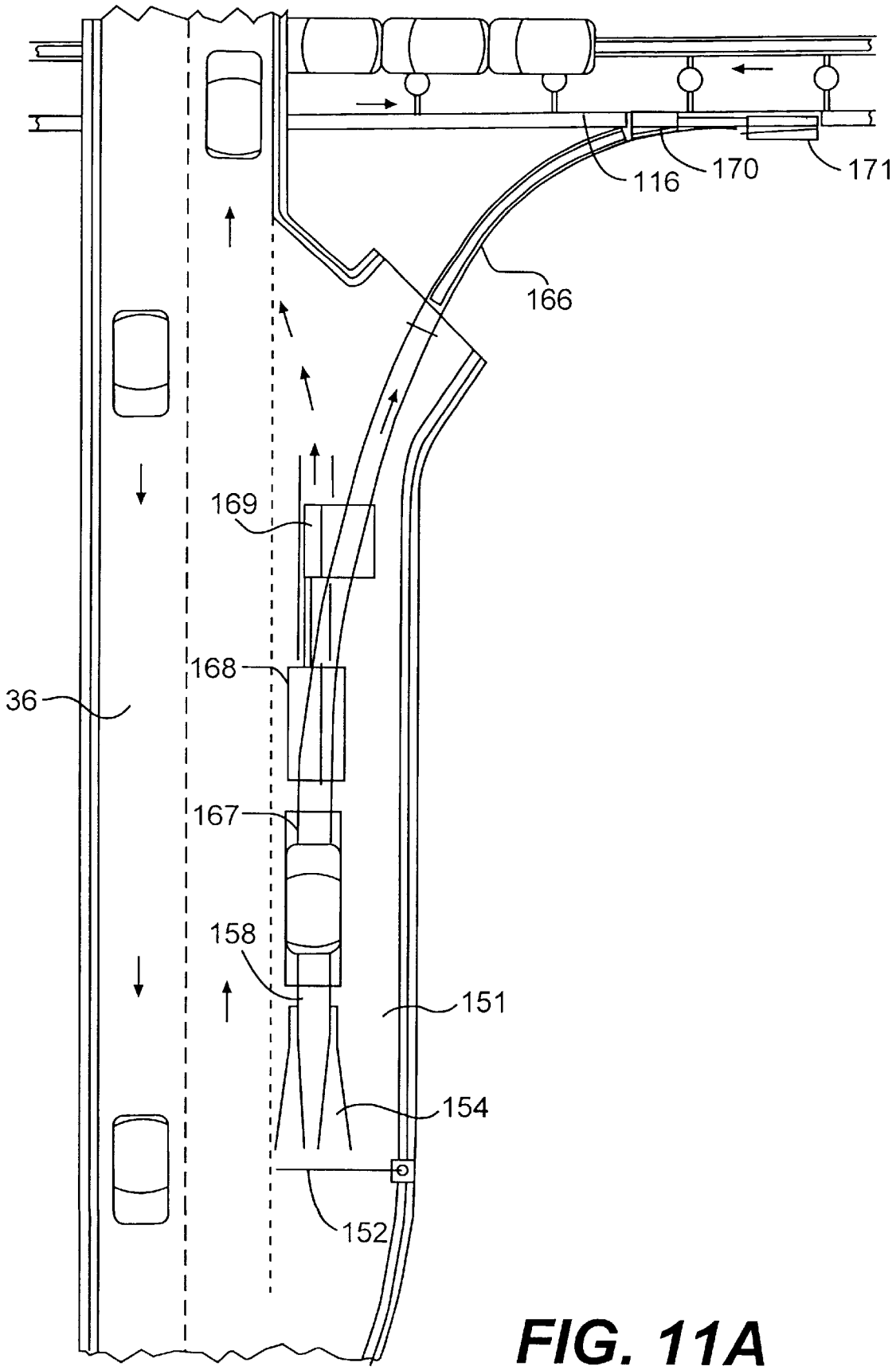
FIG. 11A is a top view of a transition zone defining an entrance ramp onto the rail system.

As shown in FIG. 11A, entrance ramp 151 is provided at an existing overpass. The entrance ramp 151 includes an automatic gate 152 that communicates with rail car computer 150 to commence the diagnostic check. A set of tire grooves 154 are provided in the road surface, along with a pair of distal ends 158 of rails 116. The distal ends 158 of the rails transition through a switch 162 and then to a transition zone 166.

Figure 14:
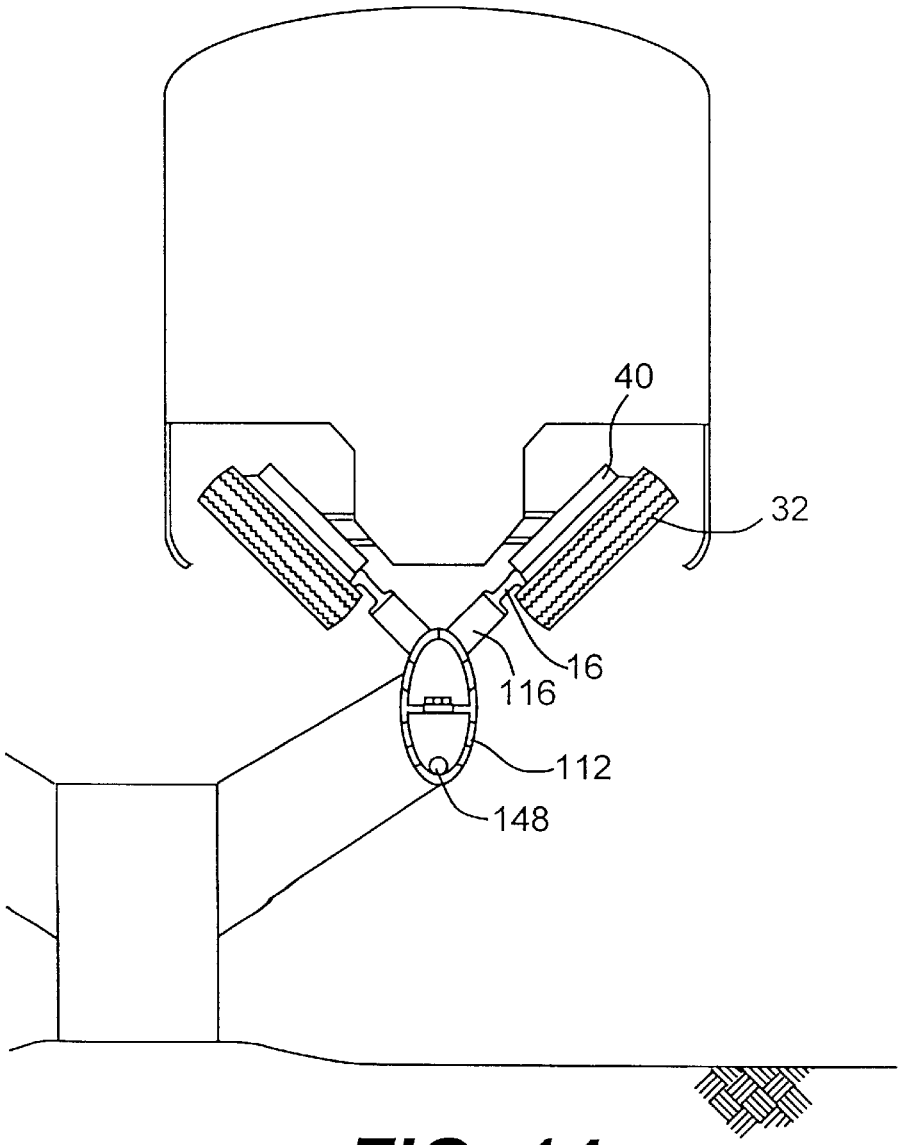
FIG. 14 depicts a locked-on engagement of the vehicle with the rail after the transition zone.

As shown in FIG. 11A, the tire grooves 154 are ramped and should be deep enough that first wheels 28 and tires 32 will descend into the grooves 154, allowing second wheels 40 to engage and ride on distal ends 158 of rails 116. At the distal ends 158, the rails are arranged to be vertical with respect to the vertical line defined by support structure 104, so that second wheels 40 will ride onto the surface of the rails. As the rails pass through transition rail section 166, the rails begin to twist outward in a sequentially greater amount until the acute angle $\theta$ is reached. It will be understood that as the rails twist through transition section 166, the first and second wheels 28 and 40 of vehicle 24 will pivot gradually about pivot point 72. When the rails reach the acute angle $\theta$, the outer flanges 44 and 128 will have lockingly and slidingly engaged, to prevent derailment, as shown in FIGS. 4, 6, and 14.

Preferably, entrance ramp 151 includes a switch 162. Referring to FIG. 11A, each switch 162 includes a diagnostic portion 167, a first table portion 168, and a second table portion 169.

As shown in FIG. 11A, as the vehicle passes over diagnostic table 167, the diagnostic check is performed to check for correct speed, diagnosis of the vehicle computer, and so on. Switch table portions 168 and 169 then shift either right or left (as oriented in FIG. 11A), to either let the vehicle enter the rail system (shifted to the right in FIG. 11A) or to shift the vehicle back onto the road (shifted to the left in FIG. 11 A), depending on whether the vehicle passes or fails the diagnostic check.

Figure 11B:
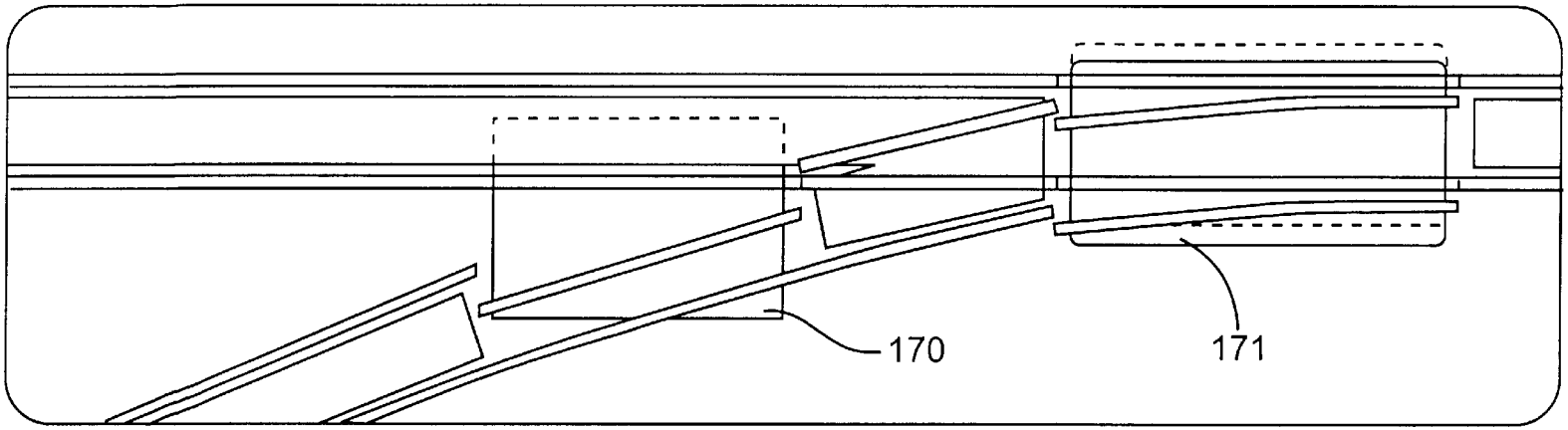
FIG. 11B is an enlarged partial view of a switch at the transition zone in FIG. 11A in the "through traffic" position.
Figure 11C:
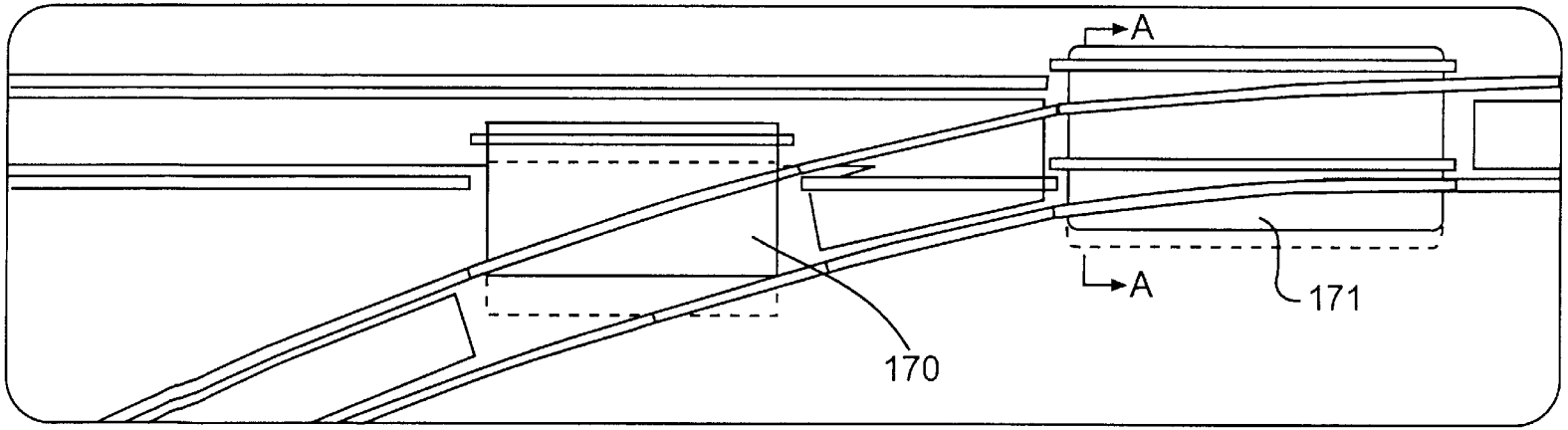
FIG. 11C is an enlarged partial view of a switch at the transition zone in FIG. 11A in the "entering traffic" position.

As shown in FIGS. 11A, 11B and 11C, additional switch table portions 170 and 171 are provided at the rail side of entrance ramp 151. When no new rail traffic is entering, and through rail traffic only is passing through switch table portions 170 and 171, these tables are shifted into the "through traffic" position (upward in FIG. 11 B). Conversely, when new traffic is entering the rail system, tables 170 and 171 are shifted into the "entering traffic" position (downward in FIG. 11C).

The acute angle of the rail portions 116 at switch table portion 171 can be seen in the cross-sectional view A—A shown in FIG. 11D. It will be further understood that switch table portions 170 and 171 require straight rail segments 116*a* (on the "through traffic" side of the switch) and curved rail segments 116*b* (on the "entering traffic" side of the switch), as shown in FIG. 11D.

Figures 12A, 12B:
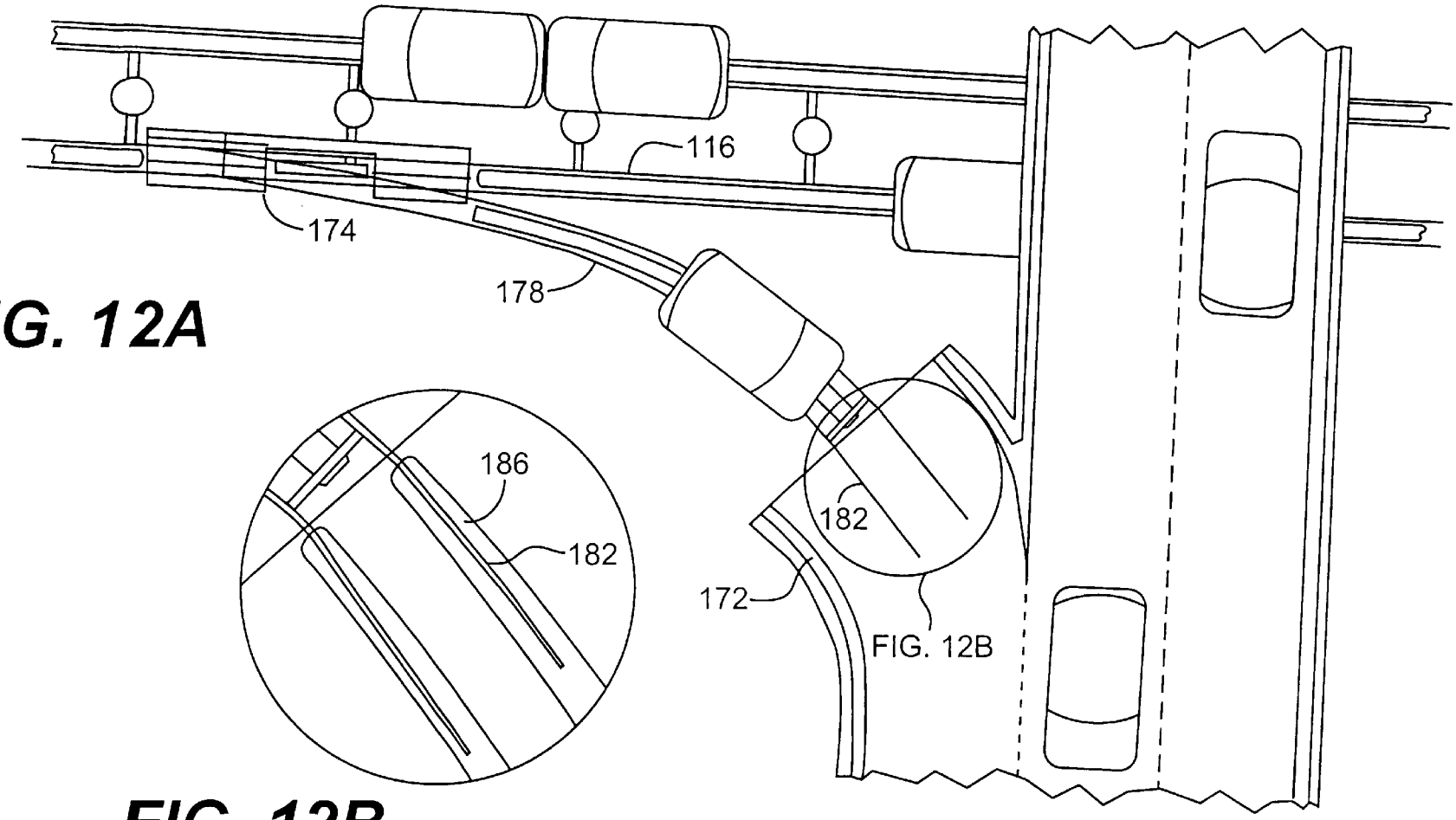
FIG. 12A is a top view of a transition zone defining an exit ramp off of the rail system.
FIG. 12B is an enlarged view of the distal ends of the rails and tire grooves at the transition zone in FIG. 12A.
Figure 13:
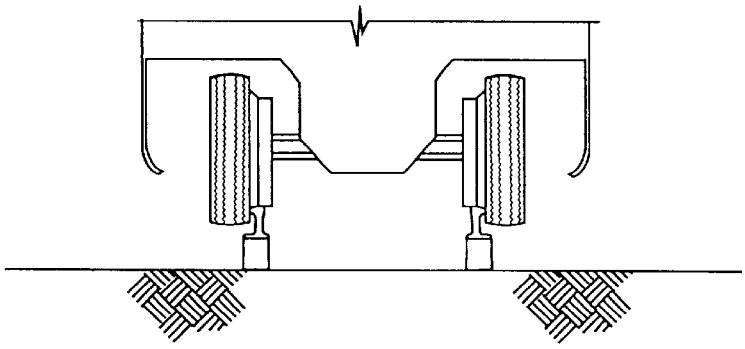
FIG. 13 depicts contact between the second wheel and the rail when entering or leaving the rail at the entrance ramp or exit ramp transition zones.

FIGS. 12A and 12B depict an exit ramp transition zone 172. The exit ramp includes a switch table 174, a transition rail 178, a pair of distal rail ends 182, and a set of tire grooves 186. The structure of the components of exit ramp 172 are substantially similar to those of entrance ramp 151, but configured in reverse.

Transition of the vehicle 24 from the rail 116 to the road surface 36 at exit ramp 172 is further explained below. While the vehicle 24 is traveling on rails 116, clutch 52 is typically engaged, so that first wheel 28 rotates with second wheel 40 and first shaft 48, while second wheel 40 is turning on rail 116. Shortly before entering the exit ramp 172, solenoid 56 receives a signal to disengage clutch 52. This signal can be sent manually by the vehicle operator, e.g., via vehicle controller 150, or can be sent automatically by system master controller 144. For example, a sensor (not shown) can be provided at switch 174, that sends an exit signal via master controller 144 or vehicle controller 150 to instruct solenoid 56 to disengage clutch 52. Once the signal is sent, clutch 52 disengages, allowing first wheel 28 and tire 32 to rotate independently. The free rotation of first wheel 28 allows it to compensate for the differential in rotational velocity at the time tire 32 engages road surface 36 at exit tire groove 186. Once tire 32 and first wheel 28 are rotating at the required velocity for road travel, clutch 52 re-engages, so that the power of the vehicle drive motor 92 is translated via second shaft 64, first shaft 48, and second wheel 40 to first wheel 28. This transition scheme avoids lurching of the vehicle 24 as it shifts from rail travel to road travel, thereby increasing the comfort of the passenger. It may also be preferable to apply an anti-friction substance in exit ramp tire groove 186 to reduce wear on tire 32 when it first engages road surface 36 while rotating at a higher speed.

In accordance with the invention, a brake is provided for slowing or stopping the vehicle on the rail. Normal braking on the rail is handled by reversing the drive motor to a generator and transferring the energy for decelerating back into the electrical grid system. If faster deceleration is required, standard disc brakes, including an anti-lock braking (ABS) system if desired, can be applied to stop rotation of the vehicle wheels. During panic braking, when friction limits between the steel rail 116 and the rubber pad 141 on second wheel 40 is exceeded, the ABS system, instead of releasing, instructs support rod 76 to push outward. This will force the wheels to pivot further about pivot point 72 and increase pressure on the rail wheel pads to abruptly stop the vehicle.

Additional advantages and modifications will readily occur to persons skilled in the art. The invention in its broader aspects, is not limited to the specific details described above. Departures may be made from such details without departing from the spririt or scope of the invention. The scope of the invention is limited only by the claims and their legal equivalents.

I claim:

1. A transportation system comprising:

a vehicle comprising:

(a) a first wheel including a tire to engage a road surface, and a second metal wheel having an outer flange, said first and second wheels mounted adjacent one another on a first shaft with said second wheel fixed to rotate with said first shaft and said first wheel mounted to rotate independently of said first shaft;

(b) a clutch between said first and second wheels for selectively engaging and disengaging said first and second wheels, said first wheel rotating with said second wheel at times when said clutch is engaged;

(c) a second shaft having a distal end pivotally connected to said first shaft at a pivot point, such that said first and second wheels on the first shaft are pivotable about said pivot point; and a rail for engaging said second wheel, such that said vehicle is capable of traveling either on the road surface or said rail, said rail including an outer flange and being positioned at a selected acute angle with respect to a vertical line such that when said second wheel engages said rail, said first and second wheels pivot about said pivot point, and said outer flange of said rail lockingly engages said outer flange on said second wheel.

2. The transportation system of claim 1, wherein said vehicle further comprises an elongated support rod linked to said second wheel, said support rod being movable in a direction generally parallel to said second shaft to pivot said first and second wheels around said pivot point.

3. The transportation system of claim 1, wherein another end of the second shaft is driven by a vehicle engine.

4. The transportation system of claim 1, further comprising a solenoid for operating said clutch.

5. The transportation system of claim 1, wherein said clutch is normally engaged, and including means for disengaging said clutch at a time just prior to said vehicle transitioning from travel on the road surface to travel on said rail, and for disengaging said clutch at a time just prior to said vehicle transitioning from travel on said rail to travel on the road surface.

6. The transportation system of claim 1, wherein said rail is elevated above the road surface.

7. The transportation system of claim 1, wherein said rail further defines a generally V-shaped track having two diverging rail portions, each rail portion positioned at opposite selected acute angles with respect to the vertical line, and each rail portion having said outer flange.

8. The transportation system of claim 1, wherein said selected acute angle is approximately 45°.

9. The transportation system of claim 1, further comprising a means for heating said rail.

10. The transportation system of claim 1, further comprising a power supply for supplying electric power to said vehicle via said rail and said second wheel when said vehicle is traveling on said rail.

11. The transportation system of claim 10, wherein said rail includes a first electrical conductor and said second wheel includes a second electrical conductor in contact with said first electrical conductor when said vehicle is traveling on said rail.

12. The transportation system of claim 10, further comprising a controller for controlling the supply of electric power to said vehicle.

13. The transportation system of claim 12, wherein said controller selectively applies electrical power to successive segments of said rail.

14. The transportation system of claim 12, wherein said controller selects a velocity of said vehicle when traveling on said rail.

15. The transportation system of claim 1, wherein said vehicle includes a magnetized front bumper retractably mounted at a front end of said vehicle.

16. The transportation system of claim 15, wherein said vehicle further includes a magnetized rear bumper retractably mounted at a rear end of said vehicle.

17. The transportation system of claim 16, wherein said front bumper defines a first arc having a first radius, and said rear bumper defines a second arc having a second radius, wherein said first radius is different from said second radius.

18. The transportation system of claim 16, wherein said vehicle further comprises fixed front and rear bumpers mounted to said vehicle adjacent said retractably-mounted front and rear bumpers.

19. The transportation system of claim 1, further comprising a plurality of transition zones for transiting said vehicle back and forth from travel on said rail to travel on the road surface.

20. The transportation system of claim 19, wherein said transition zones are provided at locations where the road surface bridges over said rail.

21. The transportation system of claim 19, wherein each said transition zone includes a groove in said road surface for receiving the tire of said first rail, and a distal end portion of said rail extending into said groove.

22. The transportation system of claim 21, wherein said transition zone includes a switch comprising a platform having rail portions, movable between a first position wherein said rail portions connect said distal end portion with said rail, and a second position wherein said distal end portion is disconnected from said rail.

23. The transportation system of claim 21, wherein said distal end portion of said rail includes a first vertical portion and a second portion that angles with respect to the vertical line in progressively greater increments until said selected acute angle is achieved.

24. The transportation system of claim 1, wherein said rail is mounted on a generally Y-shaped structure having two arms, including a pair of generally V-shaped rail portions on each arm.

25. The transportation system of claim 1, wherein said vehicle is configured to engage another vehicle when traveling on said rail to define a pod.

26. The transportation system of claim 1, further comprising a controller for checking a status of said vehicle prior to transferring from travel on said rail to travel on the road, and from travel on the road to travel on said rail.

27. The transportation system of claim 1, further comprising a braking device for slowing rotation of said second wheel on said rail.

28. The transportation system of claim 1, wherein said rail includes a mating surface engaging a corresponding engaging surface on said second wheel, each of said mating surface and said engaging surface being angled with respect to a horizontal line.

29. A vehicle capable of traveling either on a road surface or on a rail, the rail having an outer flange and being provided at a selected acute angle with respect to a vertical line, the vehicle comprising:

a first wheel rotatably mounted on a first shaft having a tire to engage the road surface;

a second metal wheel having an outer flange to engage the rail, said second wheel mounted to said first shaft adjacent said first wheel and fixed to rotate with said first shaft;

a clutch between said first wheel and said second wheel for selectively engaging and disengaging said first and second wheels, said first wheel rotating with said second wheel at times when said clutch is engaged; and a second shaft having a distal end pivotally connected to said first shaft at a pivot point, such that said first and second wheels on the first shaft are pivotable about said pivot point;

wherein at times when said second wheel engages the rail, said first and second wheels pivot about said pivot point, and said outer flange of said second wheel lockingly engages the outer flange of the rail.

30. The vehicle of claim 29, further comprising an elongated support rod linked to said second wheel, said support rod being movable in a direction generally parallel to said second shaft to pivot said first and second wheels about said pivot point.

31. The vehicle of claim 29, wherein another end of the second shaft is driven by a vehicle engine.

32. The vehicle of claim 29, further comprising a solenoid for operating said clutch.

33. The vehicle of claim 29, wherein said clutch is normally engaged, and including means for disengaging said clutch at a time just prior to said vehicle transitioning from travel on the road surface to travel on the rail, and for disengaging said clutch at a time just prior to said vehicle transitioning from travel on the rail to travel on the road surface.

34. The vehicle of claim 29, wherein said vehicle includes a magnetized front bumper retractably mounted at a front end of said vehicle.

35. The vehicle of claim 34, wherein said vehicle further includes a magnetized rear bumper retractably mounted at a rear end of said vehicle.

36. The vehicle of claim 35, wherein said front bumper defines a first arc having a first radius, and said rear bumper defines a second arc having a second radius, wherein said first radius is different from said second radius.

37. The vehicle of claim 35, wherein said vehicle further comprises fixed front and rear bumpers mounted to said vehicle adjacent said retractably-mounted front and rear bumpers.

38. The vehicle of claim 29, further comprising a controller for checking a status of said vehicle prior to transitioning from travel on said rail to travel on the road, and from travel on the road to travel on said rail.

39. The vehicle of claim 29, further comprising a braking device for slowing rotation of said second wheel on the rail.

* * * * *